US008079535B2

(12) United States Patent
Enderle

(10) Patent No.: US 8,079,535 B2
(45) Date of Patent: Dec. 20, 2011

(54) METHOD FOR RECOVERING ORE

(75) Inventor: Udo Enderle, Marktredwitz (DE)

(73) Assignee: NETZSCH-Feinmahltechnik GmbH (DE)

( * ) Notice: Subject to any disclaimer, the term of this patent is extended or adjusted under 35 U.S.C. 154(b) by 201 days.

(21) Appl. No.: 12/211,386

(22) Filed: Sep. 16, 2008

(65) Prior Publication Data

US 2009/0072057 A1 Mar. 19, 2009

Related U.S. Application Data

(63) Continuation of application No. PCT/DE2007/000475, filed on Mar. 15, 2007.

(30) Foreign Application Priority Data

Mar. 16, 2006 (DE) ..... 10 2006 012 489

(51) Int. Cl.
*B02C 23/38* (2006.01)

(52) U.S. Cl. ..... 241/21; 241/29

(58) Field of Classification Search ..... 241/21, 241/29, 152.2, 261.2, 261.3
See application file for complete search history.

(56) References Cited

U.S. PATENT DOCUMENTS

| | | | | |
|---|---|---|---|---|
| 4,325,514 | A * | 4/1982 | Hemingsley | 241/16 |
| 5,673,860 | A * | 10/1997 | Heinemann et al. | 241/1 |
| 7,249,723 | B2 * | 7/2007 | He et al. | 241/21 |

FOREIGN PATENT DOCUMENTS

| | | | |
|---|---|---|---|
| DE | 1507652 | A1 | 7/1969 |
| DE | 2205646 | A1 | 8/1973 |
| DE | 2330098 | A1 | 1/1975 |
| EP | 0238040 | A | 9/1987 |
| WO | 03022416 | A | 3/2003 |

OTHER PUBLICATIONS

International Search Report, Aug. 3, 2008 (5 pages).

* cited by examiner

*Primary Examiner* — Faye Francis
(74) *Attorney, Agent, or Firm* — St. Onge Steward Johnston & Reens LLC

(57) ABSTRACT

The invention relates to a method for the comminuting of natural or synthetic mineral products having a size of 10 nm to 30 mm, which are obtained from the upstream process in pre-comminuted form for example in a roller mill for inter-particle comminution, wherein these solids are further comminuted in a working process initially dry then wetted with liquid and in this liquid are comminuted so as to obtain a suspension that can be pumped, which suspension is subsequently ground to the desired final fineness by means of agitating mills.

14 Claims, 3 Drawing Sheets

METHOD FOR RECOVERING ORE

CROSS-REFERENCE TO RELATED APPLICATIONS

The present application is a continuation of pending International patent application PCT/DE2007/000475 filed on Mar. 15, 2007 which designates the United States and claims priority from German patent application 10 2006 012 489.8 filed on Mar. 16, 2006, the content of which is incorporated herein by reference.

FIELD OF THE INVENTION

The invention relates to a method and a device for the comminuting of natural or synthetic mineral products.

BACKGROUND OF THE INVENTION

This method for comminuting is especially intended for products having a size of 10 nm to 30 mm. These mineral products are produced on an oil or water base on an industrial scale. From the processing of ore rock, mineral raw materials such as calcium carbonate or titanium dioxide following calcination there is usually the need to comminute the solids in a liquid. To this end, modern methods with tumbling mills are very widely distributed in dry as well as in wet processing.

However, these methods have the disadvantage that they require lots of energy for this specific comminuting task.

The object of the present invention consists in providing a method and a device for the production and comminution of natural synthetic mineral products, with which the energy input can be substantially reduced.

This object is solved through the present invention. Advantageous further developments emerge from embodiments disclosed herein.

SUMMARY OF THE INVENTION

According to the method according to the invention the mineral products, which are obtained pre-comminuted from an upstream process, are continuously further comminuted in a further working process initially dry and subsequently wetted with liquid. This suspension that can be pumped produced in the process is then subjected to a process in a stage in which it is pre-comminuted. This stage finally is followed by a final stage in which the desired final fineness is achieved. This process takes place either on external agitating mills or on so-called gap mills with a gap smaller than 1 mm.

The method is mainly intended for industrial use, for throughputs from 1 to 60 tons per hour of solid material. In a further embodiment of the invention according to the invention the dispersion in combination with a circuit vessel is operated quasi stationarily.

Likewise according to the invention, the agitating front gap mill arranged at the end of the comminution process is continuously supplied with products from the circuit vessel for stationary dispersion. The dry comminution provided at the start of the manufacturing process is carried out either through mechanical impact mills which accelerate the product, flinging it against an impact surface or in that the coarse materials are directed against impact surfaces or against product jets directed in the opposite direction by means of high pressure in form of an air or liquid jet.

According to the invention, the product can be conducted through a ring gap at the end of the stationary comminution process whose gap width is between 50 nm to 3 mm. In this gap the suspension of mineral products receives its final fineness or the fineness with which in a following operation the final fineness is achieved with little energetic effort. Depending on the kind of product the ring gap can also have a size of 500 nm to 2 mm.

The device for the processing of mineral products with low energy expenditure according to the invention comprises a vessel having a solid material inflow and a liquid inflow as well as an outlet. Over the length of the vessel between the solid inflow and the outlet, four process chambers are distributed over the longitudinal axis of the vessel.

According to a further development of the invention a dry pre-comminuting device is located in the first process chamber which consists of a combination of grinding pins on the grinding vessel and grinding pins on a shaft. Also possible in the first process chamber are the arrangements of mechanical impact and roller mills as well as pneumatic impact mills among other things also for comminuting in the counterflow. Depending on which energy is available at the production location the driving methods of the individual processing means are selected.

According to an inventive embodiment of the device a second process chamber for the wetting of the dry substances follows the first process chamber for pre-comminution. For the improved wetting of the dry substances, tools are arranged in this second process chamber which radially accelerate the dry substances as a result of which the wetting between the tools and the vessel wall is improved since the product comes in contact with the liquid in a finely distributed form and thus each powdery particle is provided with liquid on its entire surface.

According to a further development of the invention grinding and mixing tools are provided in the third process chamber for improving the homogeneity of the product consisting of dry substances and liquid, which are arranged both on the agitating shaft as well as on the vessel wall. Through the combination of rotating and stationary tools, high centrifugal forces with high energy input are generated.

In front of the outlet of the device in a further development of the invention in the fourth process chamber is seated a grinding and dispersion device through which the product flows in radial direction. The device in this exemplary embodiment consists of ring elements of which the one is provided in a stationary and the other in a rotating manner. The two ring elements are manufactured from wear-resistant material, such as ceramic, SiC, phenolic or epoxy resin, hard metal, PU, rubber or elastomer or at least coated with these aforementioned materials. The ring elements are detachably connected to the vessel as well as to the shaft. The distance between the two ring elements is 50 nm to 3 mm, preferentially 500 nm to 2 mm.

According to a further development of the invention a rotor is located in the outlet region on whose circumference vanes are arranged. In that the rotor has a larger diameter than the grinding vessel in the region of the process chambers 1, 2 and 3 the discharge speed at the product outlet is thus increased. At the same time, the vanes influence the dwell time of the product between the ring elements, so that an adequate flow velocity is generated even with a relatively small gap width between the ring elements. By selecting different vane embodiments or arranging the vanes under certain angles, the flow velocity of the product between the ring elements can be adjusted or varied. Just as the ring elements can be created from wear-resistant material, coating of the inner surface of the vessel in the process chambers 1, 2 and 3 for the purpose of longevity of the device or contamination of the product with abrasion from the milling vessel is appropriate for certain products.

BRIEF DESCRIPTION OF THE DRAWINGS

Various embodiments of the device according to the invention are explained in more detail in the following by means of the enclosed schematic figures.

DETAILED DESCRIPTION OF THE INVENTION

Figure 1:
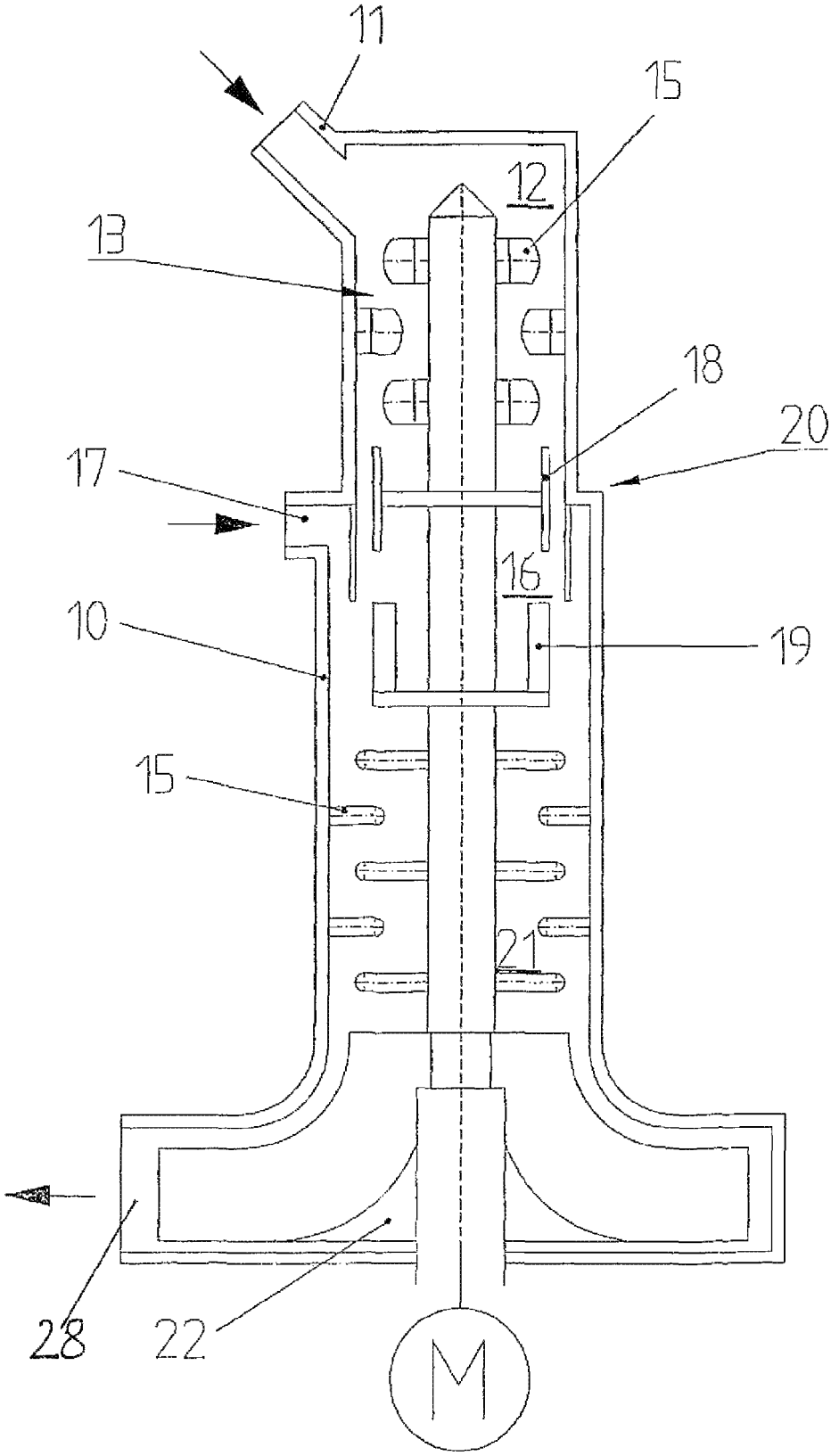
FIG. 1 is a longitudinal section of a schematic representation of the device according to the invention with a discharge rotor.

FIG. 1 shows a device with a vessel 10. This vessel is subdivided into four process chambers 12, 16, 21, 22. On the upper side of the first process chamber 12 is located the solid material inflow 11, which is inclined in flow direction or towards the shaft 14. The comminuting device 13 arranged in the first process chamber 12 consists of grinding elements 15, for example grinding pins which are fastened to the shaft 14 and grinding elements 30, likewise grinding pins, which are fastened to the inner wall of the vessel 10. The dry substances introduced in the direction of the arrow in this way reach the first process chamber and are pre-comminuted between the grinding elements 15 and 30.

Following this, the pre-comminuted product reaches the second process chamber 16, in which the radially acting tools 18, 19 are arranged. The two tools 18 and 19 accelerate the product so that the liquids predominantly introduced via the liquid inflow 17 in a tangential manner are introduced into the rotating dry product homogenously. Through the rotation of the dry product and through the tangential introduction of the liquids there are almost no differential velocities between dry material and liquid as a result of which the wetting operation is imparted greater efficiency.

For the improved dispersion of the mineral products comminution elements in form of grinding pins 15 are also arranged in the third process chamber 21 over a section which is extended compared with the process chamber 12. Because of the rotating pins and the stationary pins, differential velocities are also created between these grinding pins which have an effect on the product and which result in an increased energy input.

In FIG. 1 the third process chamber is only embodied shortened. The fourth process chamber 22 immediately joins this third process chamber in which in FIG. 1 only a rotor 25 in form of the rotor of a vane pump is arranged.

Figure 2:
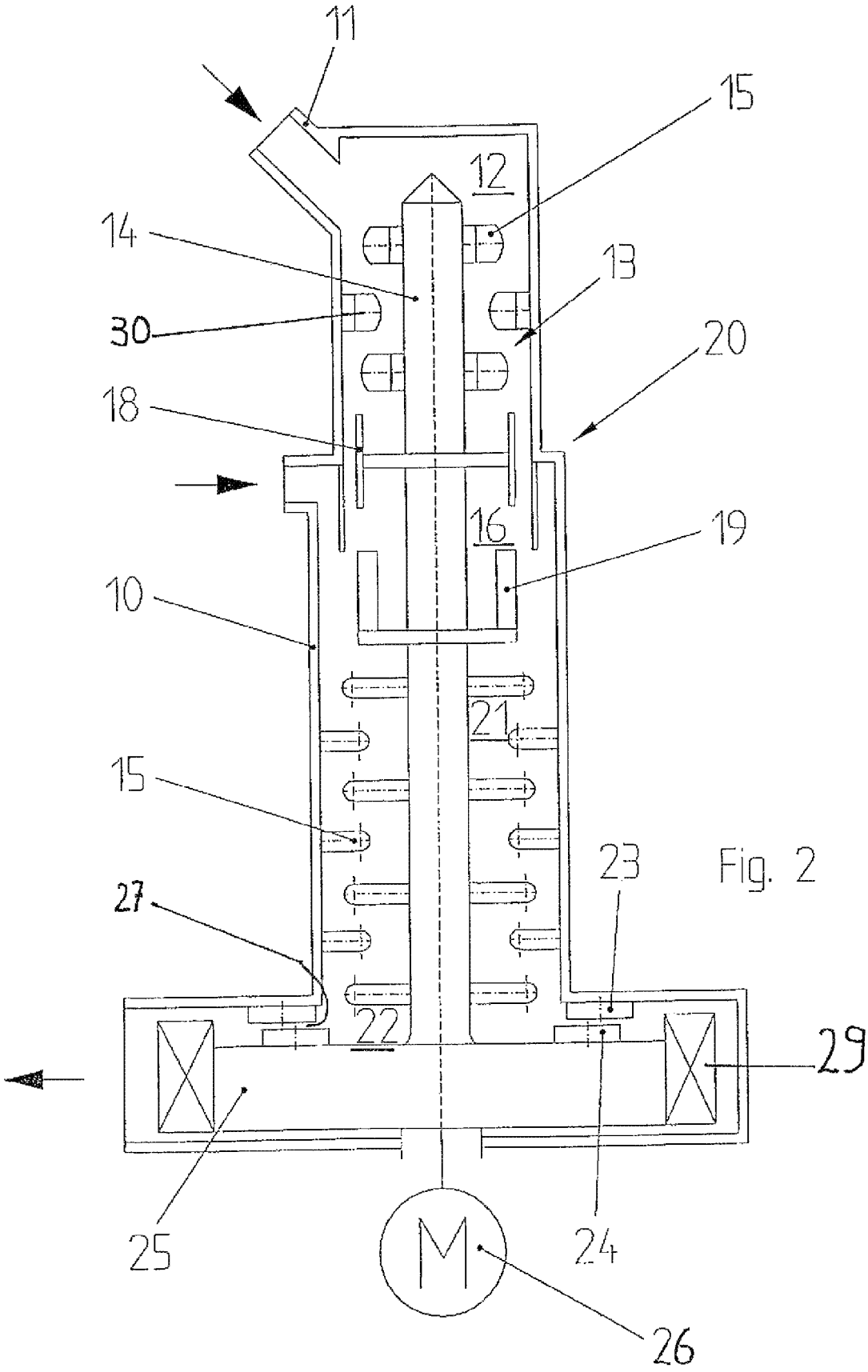
FIG. 2 is a longitudinal section of a schematic representation of the device according to the invention with a discharge rotor with additional grinding device.

FIG. 2 however shows a fourth process chamber 22 in which not only a rotor 25 with vanes 29 is placed but a further comminuting device is seated which consists of ring elements 23, 24. Since the arrangement of the ring elements 23, 24 is axially offset, the mineral product or products flow better through the intermediate space between the ring elements 23 and 24 designated as comminuting gap/ring gap 27. Depending on the distance of the two ring elements 23 and 24 from each other, these two elements process the meanwhile liquid mineral product either as far as the final fineness or as far as the fineness which is desired as charging size for further treatment on agitating mills.

The ring elements 23, 24 like the tools 15, 30 and 19, 20 are made of wear-resistant material such as ceramic, SiC, phenolic or epoxy resin, hard metal, PU, rubber or elastomer if required. The same material equipment is obviously also possible for the discharge rotor or the vanes on the discharge rotor.

Figure 3:
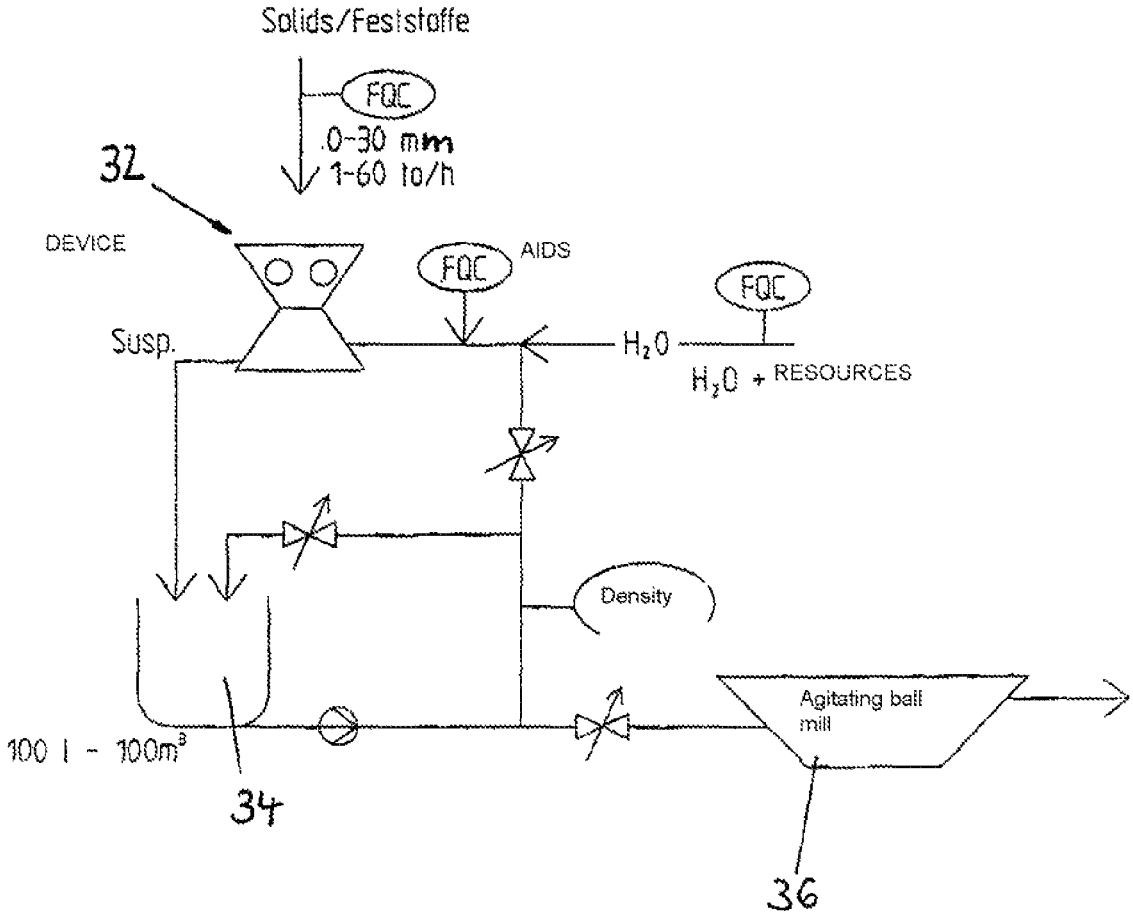
FIG. 3 is a flow diagram with respect to the manufacturing method.

FIG. 3 shows the flow diagram of the product and the liquids during the production with the grinding and dispersion devices 32 shown in FIG. 1 and FIG. 2. Via the flow control FQC the dry substances reach the first process chamber in quantities from 1 to 60 tons per hour and a size of up to 30 mm, in which chamber dry pre-comminution takes place; here symbolically embodied as roller mills. Laterally, into the region of the second process chamber then lead the supply lines for the liquid auxiliary substances, solvents, stabilizers, binding agents, liquefiers ($H_2O$) etc. At the bottom left the line leads from the fourth process chamber or the outlet for the processed suspension of solid material and liquid into an intermediate vessel of 100 litres to 100 $m^3$. If this dispersion should fail to result in the desired fineness in one operation, the suspension can be re-supplied to the vessel 10 for a second comminution or dispersion operation. If the dispersion operation and the pre-comminution are adequate, the intermediate vessel 34 or the vessel 10 direct is followed by an agitating mill or agitating ball mill 36 in order to give the product the necessary final fineness.

What is claimed is:

1. A method for comminuting natural or synthetic mineral products to a size of 10 nm to 30 mm with reduced energy expenditure comprising:

providing a supply of solids having a size up to 30 mm;

dry comminuting the solids;

wetting the dry comminuted solids into a suspension; and conveying the suspension to a gap mill having a gap between a stationary ring element and a rotating ring element that reduces the particle size to between 10 nm and 30 mm.

2. The method of claim 1 wherein throughput amounts to 1 to 60 tons per hour of solids.

3. The method of claim 1 wherein the wetting takes place within a circuit vessel.

4. The method of claim 3 wherein the gap mill is continuously supplied with product from the circuit vessel.

5. The method of claim 1 wherein the dry comminuting takes place through impact loading.

6. The method of claim 1, wherein the gap mill has a gap width of 50 nm to 3 mm.

7. The method of claim 6, wherein the gap mill has a gap width of 500 nm to 2 mm.

8. A method for comminuting natural or synthetic mineral products to a size of 10 nm to 30 mm with reduced energy expenditure comprising:

providing a supply of solids having a size up to 30 mm;

dry comminuting the solids;

wetting the dry comminuted solids into a suspension;

conveying the suspension to a gap mill having a qap between a stationary ring element and a rotating ring element that reduces particle size; and mechanically milling the particle size to between 10 nm and 30 mm.

9. The method of claim 8 wherein throughput amounts to 1 to 60 tons per hour of solids.

10. The method of claim 8 wherein wetting takes place within a circuit vessel.

11. The method of claim 10 wherein the gap mill is continuously supplied with product from the circuit vessel.

12. The method of claim 8 wherein dry comminution takes place through impact loading.

13. The method of claim 8, wherein the gap mill has a gap width of 50 nm to 3 mm.

14. The method of claim 13, wherein the gap mill has a gap width of 500 nm to 2 mm.

* * * * *